US008221164B1

(12) United States Patent
Lazaro, Jr.

(10) Patent No.: US 8,221,164 B1
(45) Date of Patent: Jul. 17, 2012

(54) MODULAR CABLE CLAMP WITH HIGH IMPEDANCE SURFACE

(75) Inventor: Luis J. Lazaro, Jr., Shoreline, WA (US)

(73) Assignee: The Boeing Company, Chicago, IL (US)

( * ) Notice: Subject to any disclaimer, the term of this patent is extended or adjusted under 35 U.S.C. 154(b) by 306 days.

(21) Appl. No.: 12/609,790

(22) Filed: Oct. 30, 2009

(51) Int. Cl.
*H01R 13/648* (2006.01)

(52) U.S. Cl. ..... 439/607.41; 439/607.44

(58) Field of Classification Search ..... 439/607.41, 439/607.44
See application file for complete search history.

(56) References Cited

U.S. PATENT DOCUMENTS

| | | | | |
|---|---|---|---|---|
| 5,368,504 | A * | 11/1994 | Muzslay et al. | 439/607.44 |
| 5,807,138 | A * | 9/1998 | Guiol | 439/607.41 |
| 5,895,291 | A * | 4/1999 | Furio et al. | 439/607.41 |
| 6,116,955 | A | 9/2000 | Lazaro, Jr. | 439/610 |
| 6,276,967 | B1 * | 8/2001 | Hall | 439/607.41 |
| 6,375,509 | B2 * | 4/2002 | Mountford | 439/607.41 |
| 6,406,329 | B1 | 6/2002 | Lazaro, Jr. | 439/598 |
| 6,616,482 | B2 * | 9/2003 | De La Cruz et al. | 439/607.44 |
| 6,764,350 | B2 * | 7/2004 | Kosmala | 439/752 |
| 6,846,201 | B2 | 1/2005 | Lazaro, Jr. | 439/598 |
| 7,044,789 | B2 * | 5/2006 | Yohn et al. | 439/599 |
| 7,837,495 | B2 * | 11/2010 | Baldwin et al. | 439/459 |
| 2009/0264003 | A1 * | 10/2009 | Hertzler et al. | 439/299 |

* cited by examiner

*Primary Examiner* — Tho D Ta
(74) *Attorney, Agent, or Firm* — Caven & Aghevli LLC

(57) ABSTRACT

A cable terminating and grounding apparatus and method may comprise a backshell including a cable terminating and grounding adapter shield which may comprise a cable receiving and positioning portion comprising a plurality of individual cable passages around the outer rim of the receiving and positioning portion; and, a gathering portion adjacent the receiving and positioning portion comprising a plurality of individual cable receiving slots around an outer periphery of the gathering portion, each slot having a side wall receiving a cable shield enclosing one or more wires comprising the cable. A gathering mechanism may engage each of the cable shields oppositely from the respective slot side wall and force the respective shield into engagement with the respective slot side wall. There may be a cable passage in a center portion of the receiving and positioning portion and the gathering portion. A locking portion of the adapter shield may engage a connector.

10 Claims, 6 Drawing Sheets

MODULAR CABLE CLAMP WITH HIGH IMPEDANCE SURFACE

The present disclosure relates generally to the field of connection devices for electrical shielded cables and the like. The disclosure has particular utility for use of a cable clamp or backshell with electromagnetic emission "EME"/high intensity radio frequency "HIRF" connector assemblies, and will be discussed in connection with such utility, although other utilities are contemplated.

BACKGROUND

The disclosed subject matter relates, generally, to improvements in cable termination and grounding assemblies for improved performance in EME/HIRF utilizations, including through enabling more repeatable, reliable and reworkable assembly/installation and better shield grounding. There are several important considerations in the designing of such an assembly. First, the cable clamp, also called a "backshell", can be used as an EME/HIRF grounding device providing high surface transfer impedance shielding, noise immunity and susceptibility, at all frequency ranges and as a strain relief device providing mechanical support or both in the assembly of electrical shielded cable. Second, the performance attributes of a cable clamp such as its shielding (conductivity) properties, coupling mechanism, corrosion resistivity and usage application should preferably be maximized at least to some extent while the related assembly tools and operator skill/learning attributes should be minimized at least to some extent. Another desirable feature would be the provision of an environmental sealing capability which would prevent ingress of contaminants, fluid or grime or otherwise, onto the electrical connector. In particular, cable clamps installed in applications such as aircraft may be subject to fluids such as fuel, cleaning fluid, lubricating fluid, deicing fluid, hydraulic fluid, water and other substances not desired to contact electrical connections.

While prior art cable clamp mechanisms have been industry accepted, several deficiencies and disadvantages exist. For example, ground shield termination using lugs and a commonly accepted method called "banding" to terminate electrical cable individual and overall shields requires laborious, error-prone, non-reusable assembly. Another example is the plating finish used to protect the "backshell" from corrosion inducing contaminants such as hydraulic, aviation and deicing fluids, and other contaminants while meeting electrical shielding and conductivity requirements. Also, the cost associated with customized cable clamps, to be either straight or angular due to installation usage, can be significant.

Existing solutions can employ devices and assembly processes and methodology that are in need of improvement. Surface transfer impedance ("STI"), resistance (at low frequency) and mutual inductance (at high frequency) have proven to be a function of the cable shield and backshell assembly process at installation and the mating of the backshell and connector during installation, including variability in the shield coverage of the backshell. Existing solutions are also less than cost effective and can be improved in terms of weight considerations.

Various backshell cable termination and grounding designs are known in the art for use in the same or similar applications as evidenced by U.S. Pat. Nos. 6,846,201, 6,406,329, and 6,116,955, owned by applicants assignee, the disclosures of which are hereby incorporated by reference.

Despite these developments, there remains a need for a cable backshell assembly that can facilitate the connection and performance of the electrical cable to a connector, while eliminating the prior art individual cable shielding termination and shielding tape used to attempt to enhance electromagnetic emission ("EME") and/or high intensity radio frequency ("HIRF") properties. Also needed is improvement in environmental protection of the design.

Accordingly, there is a need in the art for an improved cable termination and grounding mechanism that may be efficiently and cost-effectively used and/or produced and/or installed.

SUMMARY

The present disclosure provides an apparatus and method of using the apparatus which may comprise a cable terminating and grounding assembly that may comprise a cable terminating and grounding adapter shield which may comprise a cable receiving and positioning portion comprising a plurality of individual cable passages around the outer rim of the receiving and positioning portion; and, a gathering portion adjacent the receiving and positioning portion comprising a plurality of individual cable receiving slots around an outer periphery of the gathering portion, each slot having a side wall receiving a cable shield enclosing one or more wires comprising the cable.

The apparatus and method may further include a gathering device engaging each of the cable shields oppositely from the respective slot side wall and forcing the respective shield into engagement with the respective slot side wall. The apparatus and method may further comprise a cable passage in a center portion of the receiving and positioning portion and the gathering portion.

The apparatus and method may further include a locking portion of the adapter shield receiving and positioning portion, for engagement with a connector with which the adapter shield mates. The locking portion may comprise accessory teeth adapted to engage corresponding accessory teeth on the connector.

Another aspect of the present disclosure provides a cable terminating and grounding clamp assembly comprising such a cable terminating and grounding adapter shield as described above. The clamp assembly may further comprise a sheath and a coupling nut holding the cable terminating and grounding adapter shield for connection to a connector. The receiving, positioning and gathering portions of the adapter shield may comprise a conductive material.

Another aspect of the present disclosure provides a method of grounding an electrical system by inserting each of a plurality of cables into passages in the outer portion of an adapter shield, drawing said cables through slots in an open portion of the adapter shield, wherein each of the slots being connected to one of the passages, and grounding an end of at least one of the cables to the backshell. The method may further comprise enclosing the cables within a sheath, which may provide some environmental protection.

BRIEF DESCRIPTION OF THE DRAWING

The features, functions, and advantages that are disclosed can be achieved independently in various embodiments of the present disclosure or may be combined in yet other embodiments further details of which can be seen with reference to the following description and drawings, wherein like numerals depict like parts, and wherein.

DETAILED DESCRIPTION

The present disclosure provides a cable termination and grounding assembly having an adapter shield which effectively minimizes the electromagnetic energy entry and/or leakage through defects in the shielding effectiveness at a cable backshell and connector junction. Also, shortcomings in the prior art of cable termination and grounding assemblies using individual shield ground wire and shielding tape are eliminated. According to various aspects of the present disclosure, applicant has developed a backshell assembly for connection to a connector. The assembly has an adapter shield that is non-conducive in an electromagnetic environment and/or during an electric transient, such as a lightning strike. That is, the assembly can hold noise spikes to a minimum such as when subjected to conducted and/or radiated emissions, including susceptibility testing.

The assembly can provide high surface transfer impedance shielding of <2.5 mOhms resistance and <20 dbΩ per decade rise at low frequency up to 1 megahertz ranges. The assembly can also avoid the need for shielding tape or equivalent to enhance shielding effectiveness while still maintaining a <2.0 mOhms resistance and <10 dbΩ per decade rise at higher frequency up to gigahertz ranges. In both instances the assembly eliminates the prior art use of an individual shield ground wire. In addition, the assembly provides a reliable, repeatable and reworkable user friendly method of installation of the assembly.

Aspects of the present disclosure provide for a cable clamp backshell that is modular, self-aligning, EME/HIRF capable, corrosion resistant and environmentally sealing. The assembly has a female adapter shield positioned within the coupling ring portion of the backshell body having a swing arm at its distal end for use as a strain relief clamp on the electrical cable. The assembly is also lighter by about one half.

The assembly provides for a single piece conductive shielding adapter shield which fully encloses the exposed wire shield creating a vacuum like atmosphere.

Figure 1:
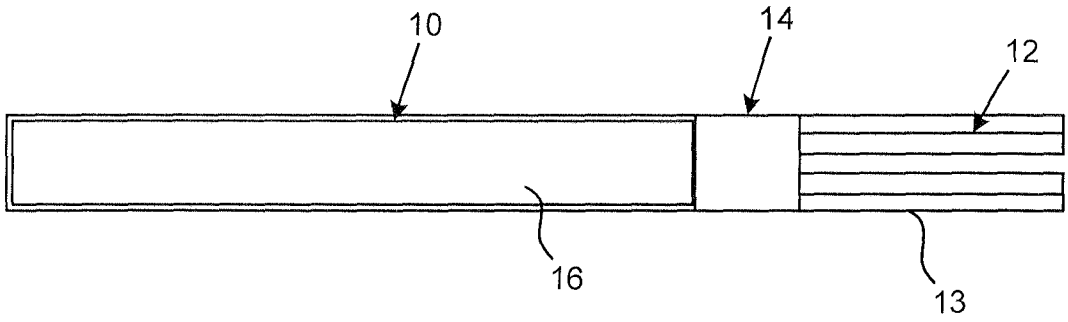
FIG. 1 shows a side view of a cable typical of cables for which a cable terminating and grounding adapter shield according to various aspects of the present disclosure may be utilized.

Turning now to FIG. 1 there is shown a side view of a cable 10 typical of cables with which a cable terminating and grounding adapter shield 20 (shown in FIG. 2) according to the present disclosure may be utilized. The cable 10 may have a plurality of wires 12 each in its own separate insulating jacket 13. The cable 10 may have a cable metal shield braid 14 made, e.g., of tin or nickel copper, and enclosing the plurality of individual wires 12. The cable 10 may also have a cable outer jacket 16 enclosing the shield 14 and the individual wires 12.

Figure 2:
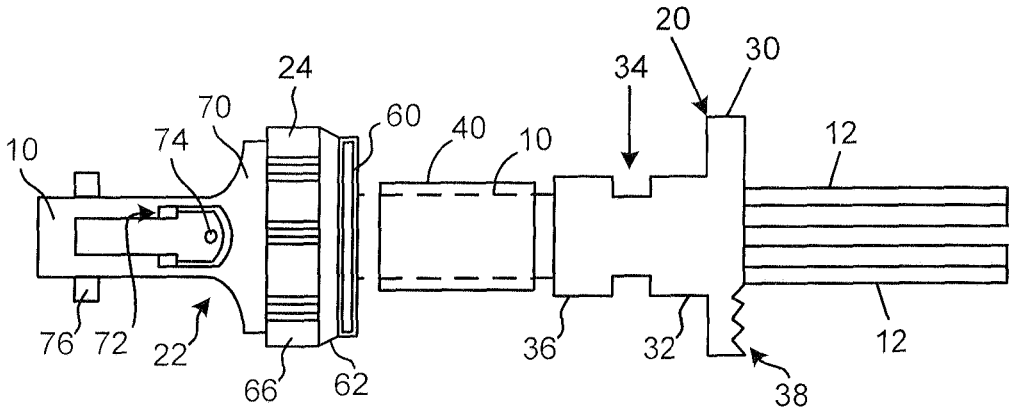
FIG. 2 shows, partly schematically and partly in cross section, a side view of a partially assembled cable terminating and grounding backshell with an adapter shield according to the present disclosure.

Turning now to FIG. 2, there is shown a partly exploded, partly schematic side view of a partially assembled cable terminating and grounding backshell assembly with an adapter shield 20 and backshell body 22 having a coupling ring 66 at its forward end 60 and a swing arm 72 at its distal end for use as a strain relief clamp, according to one example of the present disclosure. The adapter shield 20 is shown in more detail in the view of FIG. 5. The backshell body 22 may enclose the adapter shield 20 as shown in more detail in FIGS. 4 and 7. A plurality of cables 10 such as illustrated in FIG. 1 may pass through plurality of holes 100 and slots 102 positioned within periphery of adapter shield 20. The electrical cables 10 may be enclosed within an insulating shrink sleeve 40, which may also cover the adapter shield 20, but is not illustrated as such in FIG. 2.

Figure 3:
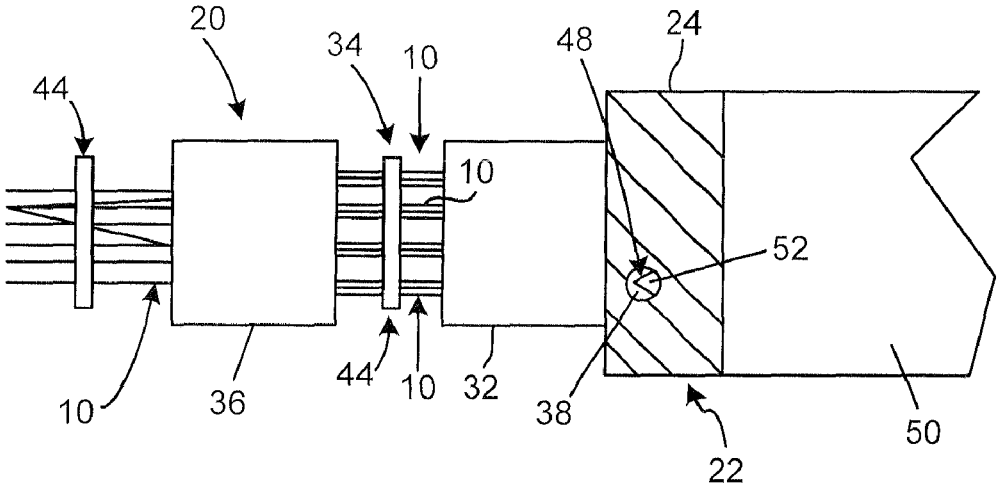
FIG. 3 shows, partly schematically, an adapter shield according to the present disclosure in connection with an electrical connector.
Figure 4:
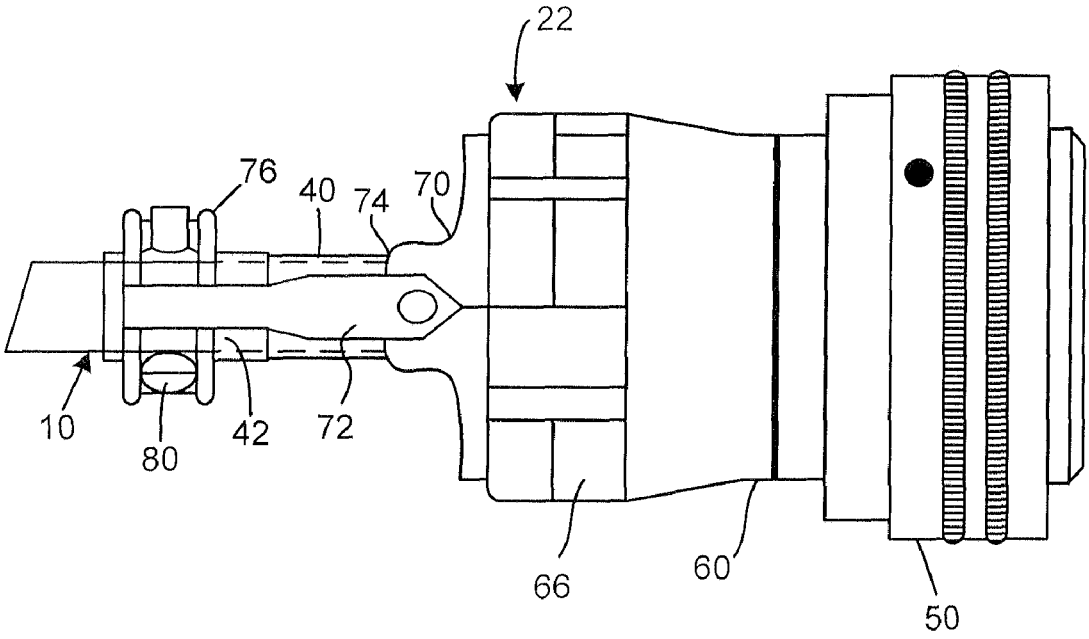
FIG. 4 shows a side view of an assembly of an electrical cable onto an adapter shield (not shown) positioned inside a backshell body whereby the backshell is in a mated position to a connector according to the present disclosure.

FIG. 3 shows partly schematically an adapter shield 20 according to one example of the present disclosure in connection with an electrical connector 50. FIG. 4 shows a side view of an electrical connector 50 and backshell body 22 in a mated position according to another example of the present disclosure.

The backshell body 22 includes a forward engagement section 24, shown schematically in FIG. 3. This illustrates the adapter shield 20 coupled to an electrical connector 50 through its interfacing accessory teeth 38 seen through the cutout hole 48 as engaged with similar teeth 52 on the connector 50. The backshell body 22 may have a coupling ring 66 at its forward end 60 and is described in further detail below. It will be understood that forward and rear as used in the present application are for convenient identification of the relative positioning of elements of the claimed subject matter, with forward being arbitrarily selected as toward the connector 50. These terms are used in this application only for relative positioning of elements of the claimed subject matter as illustrated by way of example and are not meant to be limiting of claim scope in the operating environment in which the backshell body 22 and adapter shield 20 are actually put to use.

The adapter shield 20 may also be configured to have a wide cylindrical part 30, a forward narrow cylindrical part 32, an open part 34 and a rear narrow cylindrical part 36. These may be seen in greater detail in FIG. 5. The forward wide cylindrical portion may have adapter shield interfacing accessory teeth 38, which can mate with accessory teeth 52 in a connector 50, as illustrated through a cutout opening 48 in FIG. 3. The adapter shield 20, including accessory teeth 38 may be made of a suitable conductive material such as cadmium plated aluminum or aluminum alloy which when coupled with the accessory teeth 52 of the connector 50 insure a continuous electrical path between the adapter shield 20 and connector 50.

During assembly of the backshell assembly and the connector 50 together, the backshell body 22, including a coupling ring 60 and swing arm 70, shrinkable sleeving 40 and adapter shield 20 may be inserted or slid onto a bundle of cables 10 positioned towards the connector 50. The adapter shield 20 with its plurality of holes 100 and slots 102 may be positioned whereby the full length of the electrical cable shield braid 14 on each cable is enclosed within holes 100 and slots 102 thus having individual wires 12 protruding out of adapter shield 20. The shield braids 14 on the individual cables 10 extends within the adapter shield 20 to the degree that they are at a minimum exposed in the adapter shield open part 34. Electrical contacts (not shown), as is known in the art, may then be terminated onto individual wires 12 for assembly onto electrical connector 50. Adapter shield 20 may then be coupled onto electrical connector 50 through its component interfacing accessory teeth 52.

A shrinkable sleeve 40 may be positioned over adapter shield 20 for environmental protection. The shrinkable sleeve 40 may extend along the cables from the rear of the adapter shield 20 through the backshell 20 swing arm clamp 76. FIG. 3 illustrates, partly schematically, the adapter shield 20 with cables 10 inserted, prior to enclosing this assembly in the insulative shrink sleeve 40. The visible portion of the cables 10 in the center portion 34 of the adapter shield 20, and held by the gathering member 44 are cable shielding braid 14. The backshell/connector assembly may then be completed upon coupling of the backshell body 22 onto connector 50 and closing a strain relief clamp 76 by tightening clamp screws 80 on a strain relief saddle clamp 76 connected to the swing arm 72.

Figure 6:
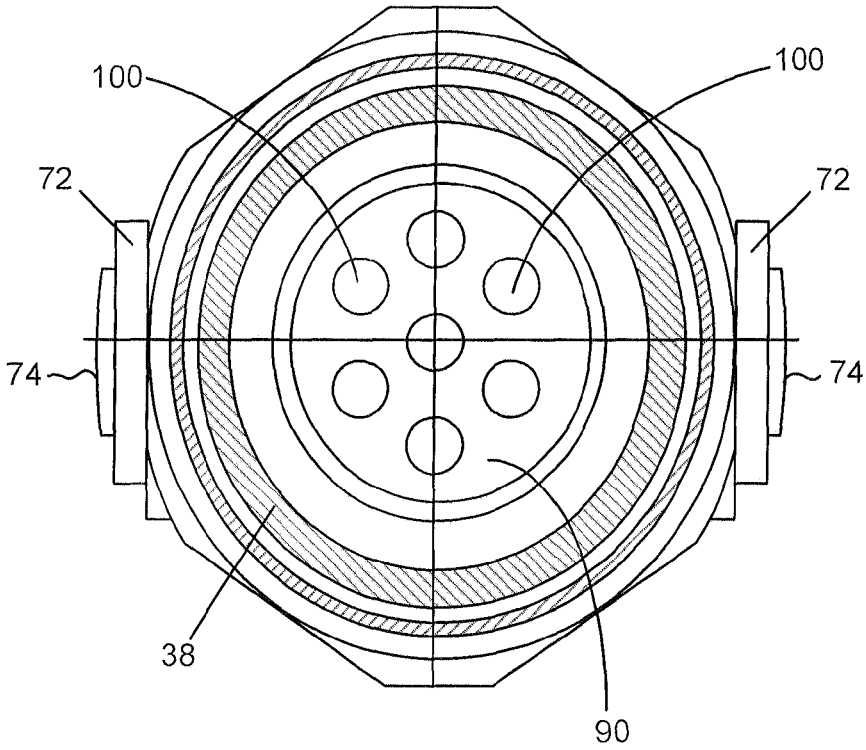
FIG. 6 shows a front view of an adapter shield according to an aspect of the present disclosure contained within a coupling ring of a backshell body with a swing arm at its distal end for use as a strain relief clamp on the electrical cable.
Figure 8A:
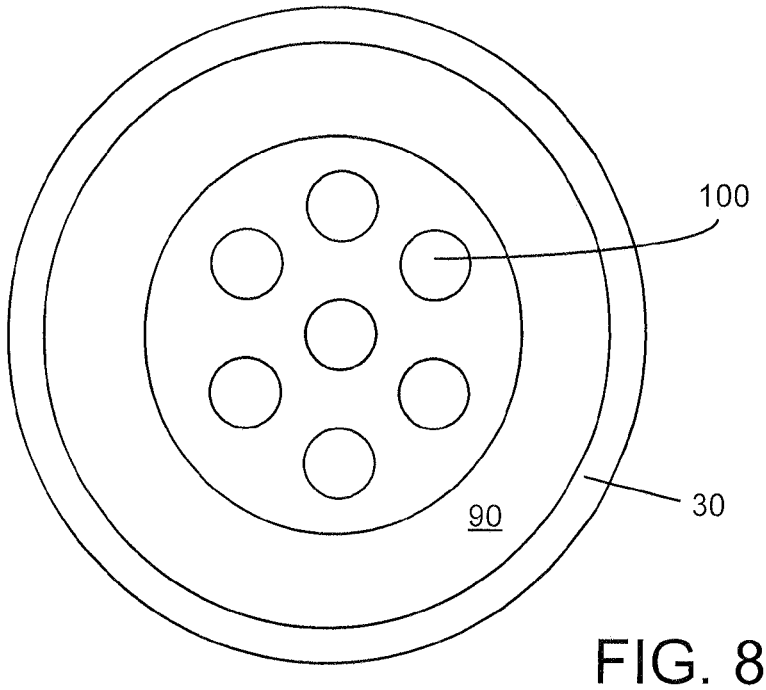
FIGS. 8A, 8B and 8C show cross sectional views of the adapter shield of FIG. 5 at cross-sectional lines 8A-8A, 8B-8B and 8C-8C respectively.
Figure 8B:
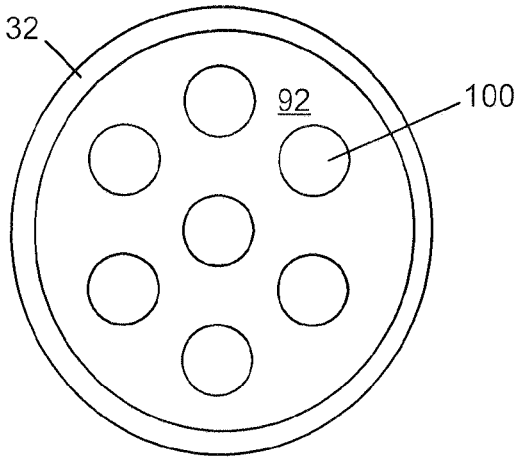
Figure 8C:
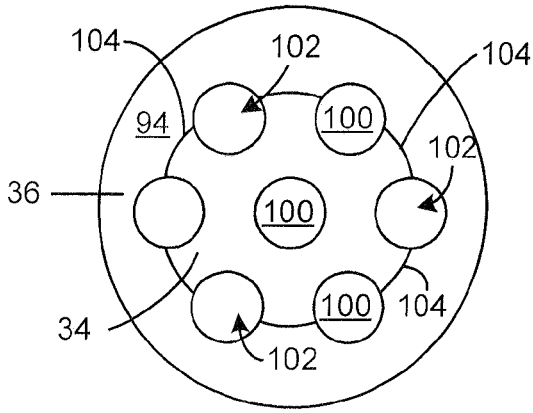

FIG. 6 shows a front view of an adapter shield according to another aspect of the present disclosure contained within the cable clamp 22 with swing arm 70, for mating with an electrical connector 50. It will be understood that there are, as shown in FIGS. 6 and 8A-8C, a plurality cable reception passage channels 100 through the adapter shield 20 starting at the wide cylindrical part 30 forward wall 90 (as seen in FIG. 8A) and continuing through the forward narrow cylindrical portion 32 internal structure 92 (as seen in FIG. 8B) and continuing through the forward section 34 (as seen in FIG. 8C) and continuing through the rear narrow cylindrical portion 36 body (not shown in FIGS. 8A-8C). The cable reception passage tubes in the open section 34 (as seen in FIG. 8C) are partly open and form slots 102 in the open section body. The passages or holes 100 may be seen starting from the adapter shield 20 cylindrical portion 36 forward wall 94 (as seen in FIG. 8C). Each of the cables 10 can be threaded through one of the passage channels 100 on the outer periphery of the adapter shield 20 onto the slots 102 continuing to holes 100 of internal structure of the forward cylindrical section 32, with individual wires 12 protruding out of adapter shield forward cylindrical end 30. This cable assembly is not limited to the number nor diameter size of cables 10. A central passage 101 may also be included and may in some examples be of a slightly larger diameter to allow, if necessary, for the threading of one or more cables 10 through the centrally positioned passage 101.

Figure 5:
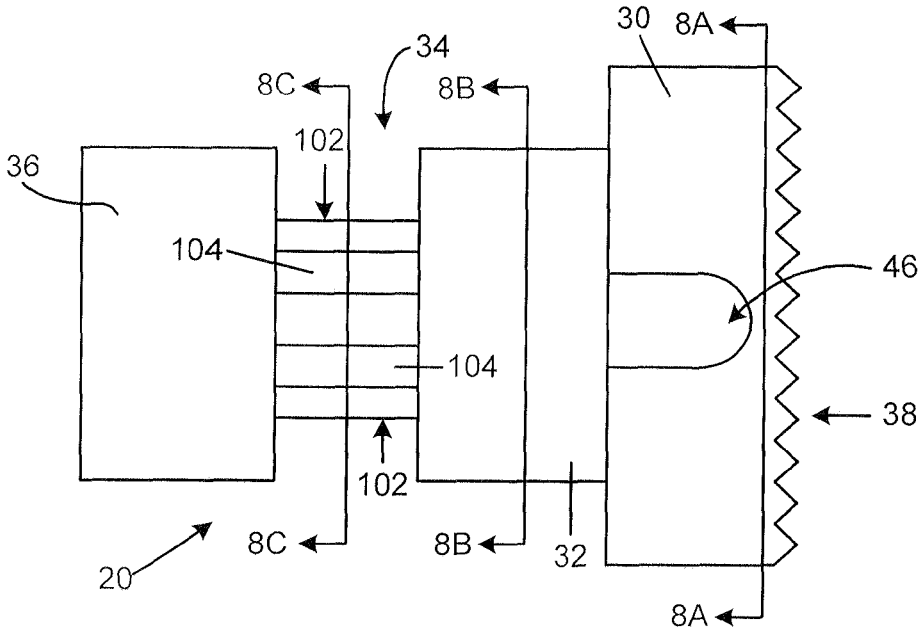
FIG. 5 shows a side view of an adapter shield according to the present disclosure.

As can be seen from FIG. 5, showing a side view of an adapter shield 20, according to this aspect of the present disclosure, and the cross sectional views of FIGS. 8A, 8B and 8C, through respective cross-sectional view lines 8A-8A, 8B-8B and 8C-8C in FIG. 5, the adapter shield 20 open part 34 forms a solid cylinder 104 with slots 102 in its outer surface. Each of the slots 102 can receive a cable 10 passing through a respective one of the peripherally positioned passages 100 in the forward and rear narrow cylindrical portions 32, 36 of the adapter shield 20. The shielding 14 on each such cable 10 may be forced against the respective slot 102 wall by a gathering device, such as, by way of example a string tie 44 (shown in FIG. 3), as is commonly used in cable bundles, placed around the cables 10 in the open portion 34 of the adapter shield 20 and tightened to force the respective cables 10 into the respective slot 102 of each, with the individual braided cable shielding sleeves 14 pressed against the wall of the slot 102.

In this manner, the shielding 14 on each cable 10 is held tightly to the slot 102 sidewall and physically separated from adjacent cables 10 by the portions 104 of the body of the open portion 34 of the adapter shield 20, but electrically connected through the adapter shield 20.

Subsequently the shrinkable sleeve 40 may be heat shrunk over the adapter shield 20, at least up to the forward wide cylindrical portion 30, and rearwardly along the cable bundle. If desired, a further sleeve gathering device 44 may be positioned adjacent the rear narrow portion 36 of the adapter shield 20, to help maintain the alignment and uniformity of position of the cables 10 extending out of the passages 100 in the rear narrow portion 36 of the adapter shield 20.

Figure 7:
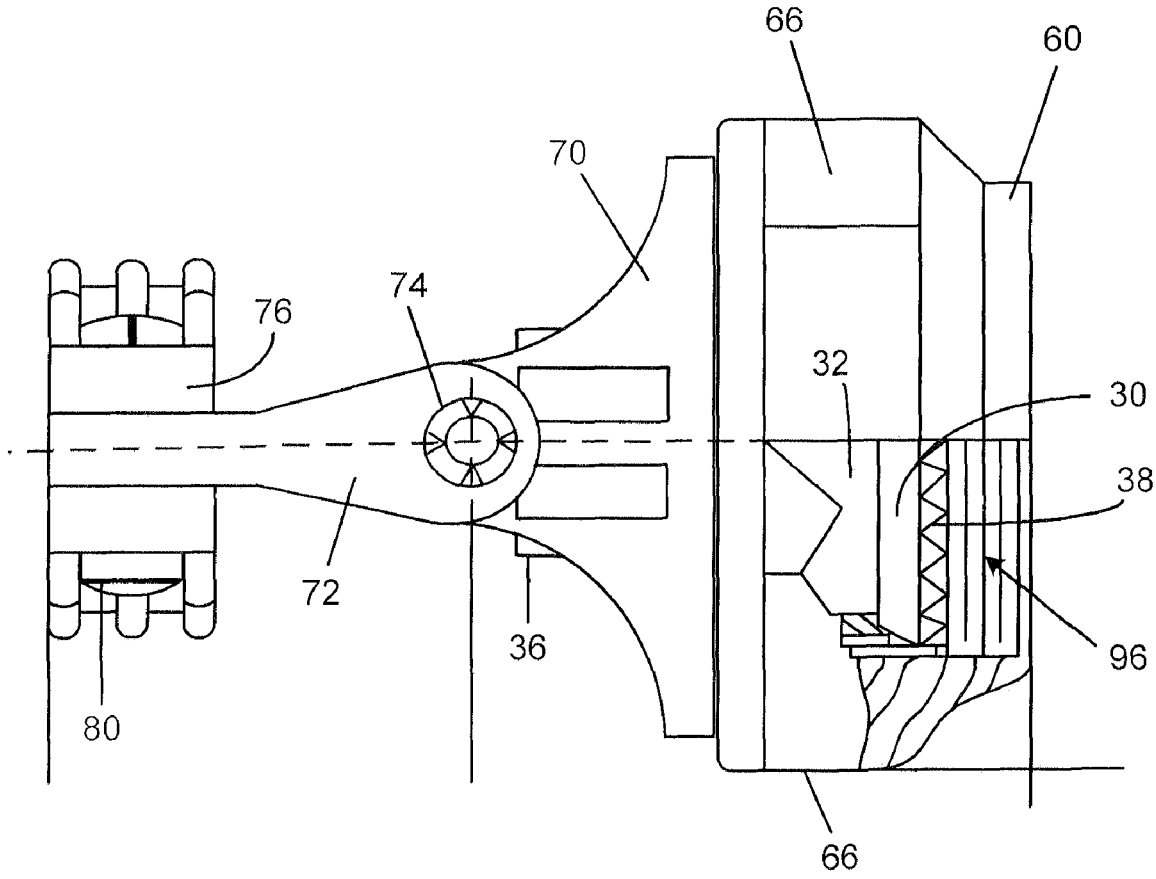
FIG. 7 shows a partially cut away side view of the adapter shield within the coupling ring portion of the backshell of FIG. 6.

FIG. 7 shows a partially cut away side view showing the adapter shield 20 within the backshell coupling ring 66. The backshell body 22 may then be slid forward over the shrinkable sleeve 40 to a position where the adapter shield 20 is fixedly positioned and contained in the backshell. As can be seen in the partial cut away portion of FIG. 7, the interfacing accessory teeth 38 of the adapter shield 20 are positioned to be coupled to interfacing accessory teeth 52 on a connector 50 (as illustrated schematically in FIG. 3), when the connector 50 is mated onto the backshell.

The adapter shield 22 may utilize a snap fitting device whereby slots 46 on the adapter shield 20 engage detent pins (not shown) on the backshell coupling ring 60 ensuring alignment and positioning of adapter shield 20 within the backshell ensuring proper engagement of interfacing accessory teeth 38 and 55 as shown in cut-away hole 48 in FIG. 3.

It will be understood that the backshell body 22 may be formed integrally with a rear portion having a-swing arm 70 with two legs 72 whereby each leg 72 may be attached to a saddle clamp 76. Two captive screws 74 engage the swing arm 70 for angular positioning, e.g. straight or 45 degree or 90 degree, of the backshell.

Alternatively, the swing arm assembly 70, 72 could be a separate part and, e.g., threadedly engaged with the backshell body 22, by external threads (not shown) in the forward portion of the swing arm assembly 70, 72 and internal threads (not shown) on the backshell body 22. The backshell coupling ring 60 may assist in aligning the backshell for threadedly engaging the connector 50.

The adapter shield 20 may be used to replace mechanical bands and shielding tapes used in the prior art EME and/or HIRF system protection on aircraft. The adapter shield 20 provides high surface impedance shielding and noise immunity at all frequency ranges, e.g. <2 mOhms resistance at low frequency and <10 dBOhms per meter per decade rise at gigahertz ranges. The cable termination and grounding assembly according to aspects of the current disclosure has been tested for RF radiated emission and susceptibility, RF conducted emission and induced spikes, and has exhibited consistent improved performance over the existing art. It has also been found to enhance environmental protection and lower procurement cost.

Figure 9:
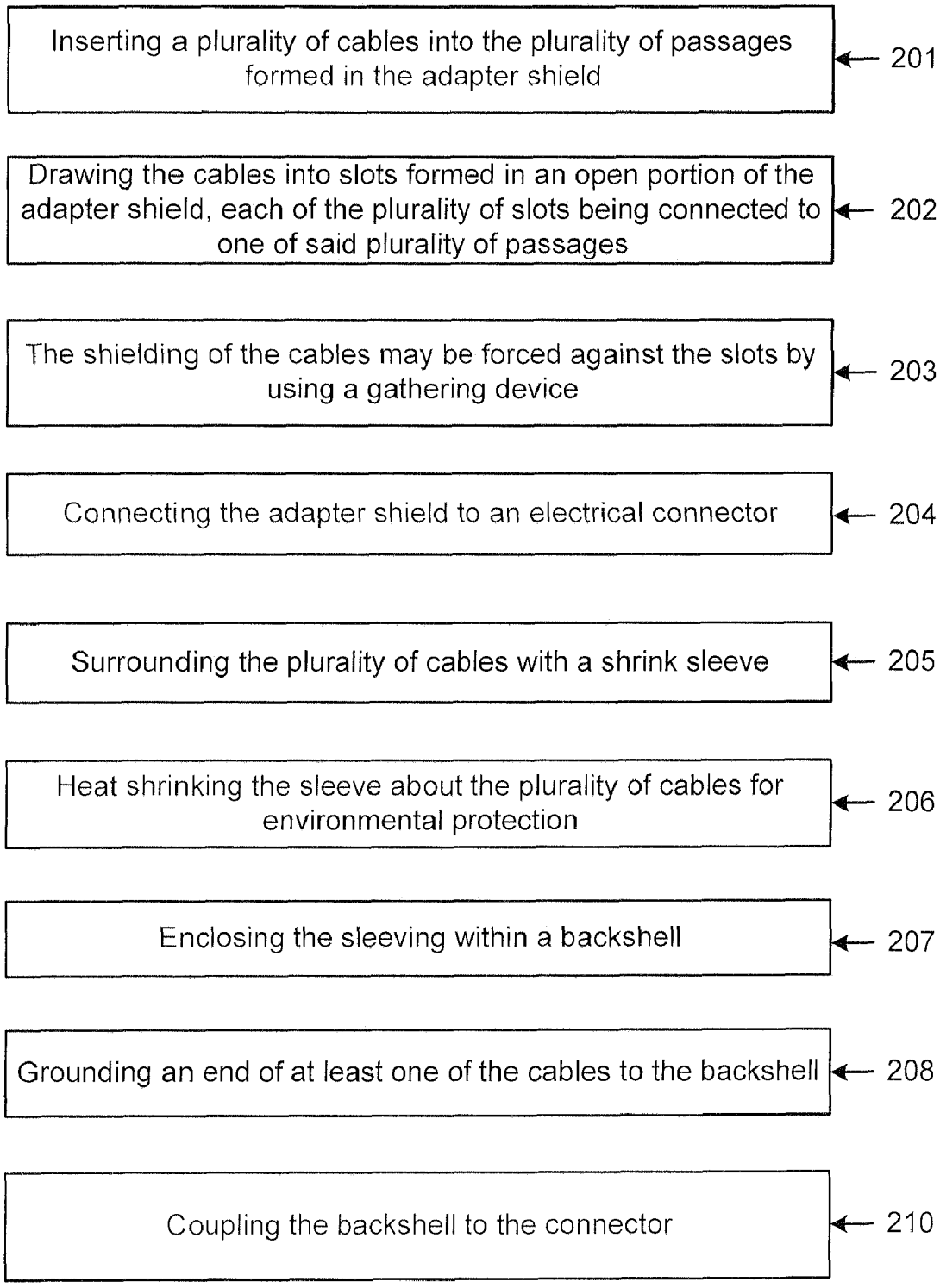
FIG. 9 is a flowchart illustrating a method of grounding an electrical system according to the present disclosure.

Another aspect of the present disclosure provides a method of grounding an electrical system utilizing one or more of the features described above. Referring to FIG. 9, the method generally comprises inserting a plurality of cables into the plurality of respective holes or passages formed in the adapter shield in step 201; drawing the cables into slots formed in an open portion of the adapter shield, each of the plurality of slots being connected to one of said plurality of passages, in step 202; and forcing the shielding of the cables against the slots with a gathering device in step 203.

The adapter shield may be connected to an electrical connector in step 204. The cables may then be surrounded by a shrink sleeve in step 205 and the sleeve may be heat shrunk around the cables for environmental protection in step 206. The sleeving may be enclosed within the backshell in step 207 and an end of at least one the cables may be grounded to the backshell in step 208. Finally, the backshell may be coupled to the electrical connector in step 210.

It should be apparent that the scope and content of the present disclosure are not limited to the above embodiments but should be considered in scope and content taking into account the manner in which the representative embodiments may be changed and modified without departing from the scope and spirit of the disclosed subject matter and claims, some of which changes and modifications have been noted above. As an example, the presently disclosed adapter shield 20 and backshell body 22 configuration and construction may be altered for use on other applications. These applications can be in components or parts to eliminate usage of coaxial, triaxial, and quadraxial contacts. Also, another use may be on gigahertz connector applications.

I claim:

1. A backshell assembly for connection to an electrical connector, comprising:

a backshell body having a forward engagement section and a coupling ring;

an adapter shield formed from a conductive material and dimensioned to be at least partially enclosed by the coupling ring and comprising:

a wide cylindrical part having interfacing teeth which mate with corresponding teeth on the electrical connector to provide a continuous electrical path between the adapter shield and the electrical connector;

a forward narrow cylindrical part;

an open part; a rear narrow cylindrical part;

a plurality of cable reception passage channels extending from the wide cylindrical part through the forward narrow cylindrical part and continuing through the rear narrow cylindrical part;

wherein the adapter shield is secured to the electrical connector by the coupling ring.

2. The following is an examiner's statement of reasons for allowance: the prior art fails to provide, teach or suggest a plurality of cable reception passage channels extending from the wide cylindrical part through the forward narrow cylindrical part and continuing through the rear narrow cylindrical part; and in combination with other limitations in claim 1.

3. The backshell assembly of claim 1 wherein the adapter shield comprises:

a central cable passage extending along a length of the adapter shield.

4. The cable terminating and grounding clamp assembly of claim 1 wherein the adapter shield comprises slots which engage detent pings on the coupling ring.

5. The backshell assembly of claim 1 wherein the backshell body further comprises a swing arm having two legs, each of which may be attached to a saddle clamp.

6. The backshell assembly of claim 5, wherein the swing arm is capable of positioning the backshell assembly at a plurality of angles relative to the electrical connector.

7. The backshell assembly of claim 1, wherein the backshell body comprises a channel to receive a cable.

8. The backshell assembly of claim 7, wherein, during assembly, the cables are threaded through the channel in the backshell body and through the cable reception passages in the adapter shield.

9. The backshell assembly of claim 8, wherein the backshell body is slidably engaged with the adapter shield such that the adapter shield is at least partially enclosed by locking ring.

10. The backshell assembly of claim 9, further comprising a shrinkable sleeve covering at least a portion of the backshell assembly.

* * * * *